US006272875B1

(12) United States Patent
Topper

(10) Patent No.: US 6,272,875 B1
(45) Date of Patent: Aug. 14, 2001

(54) GLASS DIPPING CABINET

(75) Inventor: Robert T. Topper, Heber Springs, AR (US)

(73) Assignee: White Consolidated Industries, Inc., Cleveland, OH (US)

( * ) Notice: Subject to any disclaimer, the term of this patent is extended or adjusted under 35 U.S.C. 154(b) by 0 days.

(21) Appl. No.: 09/016,824

(22) Filed: Jan. 30, 1998

Related U.S. Application Data

(60) Provisional application No. 60/036,699, filed on Jan. 31, 1997.

(51) Int. Cl.[7] ..... A47F 3/04
(52) U.S. Cl. ..... 62/248; 62/255
(58) Field of Search ..... 62/248, 255, 256

(56) References Cited

U.S. PATENT DOCUMENTS

| | | |
|---|---|---|
| 1,847,544 | 3/1932 | Weber . |
| 1,887,402 | 11/1932 | Domm . |
| 1,896,693 | 2/1933 | Battista . |
| 2,175,498 | 10/1939 | Wilnau . |
| 2,252,237 | 8/1941 | Stiles . |
| 2,360,189 | 10/1944 | Anderson . |
| 2,561,517 | 7/1951 | Ladge . |
| 2,565,795 | 8/1951 | Amundsen, Jr. . |
| 2,574,242 | 11/1951 | Brill et al. . |
| 2,661,604 | 12/1953 | Baker . |
| 2,669,851 | 2/1954 | Pichler . |
| 2,674,102 | 4/1954 | Stile . |
| 2,686,405 | 8/1954 | Pichler . |
| 2,712,733 | 9/1955 | King . |
| 2,775,873 | 1/1957 | Jones . |
| 3,680,941 | 8/1972 | Shanks . |
| 3,729,243 | 4/1973 | Musgrave et al. . |
| 3,751,653 | 8/1973 | Henry . |
| 3,860,306 | 1/1975 | Kenyon . |
| 4,400,046 | 8/1983 | Karashima . |
| 5,046,328 | 9/1991 | Yoshida et al. . |
| 5,081,850 | 1/1992 | Wakatsuki et al. . |
| 5,182,924 | 2/1993 | Trulaske, Sr. . |
| 5,402,651 | 4/1995 | Schulak . |
| 5,496,103 | 3/1996 | Kozak . |

FOREIGN PATENT DOCUMENTS

| | | |
|---|---|---|
| 8-327206 | 12/1996 | (JP) . |

*Primary Examiner*—William E. Tapolcai

(57) ABSTRACT

An improved ice cream dipping cabinet which readily permits visualization of frozen food product stored therein. The dipping cabinet has an inner box that is at least partially surrounded by an outer box. Cold, refrigerating air is circulated between the inner and outer boxes, cooling the inner box walls and the food product stored therein. The inner and outer boxes have an upper, transparent portion to permit visualization of food products stored within the inner box. The inner box has a door that is hermetically sealed to a top wall thereof to prevent moisture migration from the inner box. The outer box has an open top to permit access to the inner box door.

19 Claims, 1 Drawing Sheet

GLASS DIPPING CABINET

CROSS REFERENCE TO RELATED APPLICATIONS

The present application claims benefit of U.S. provisional application Ser. No. 60/036,699 filed on Jan. 31, 1997.

BACKGROUND OF THE INVENTION

The present invention is directed toward an ice-cream dipping cabinet that provides increased visibility of the ice cream product while, at the same time, extending the product shelf life. Maximizing product visibility is an important. criterion in the design of merchandising display cases. However, this objective has been most difficult to achieve in the design of cabinets for displaying of refrigerated products, because both the conditioning apparatus and the insulated enclosure obstruct view.

This is particularly true in the case of the traditional ice-cream dipping cabinet. Typically, dipping cabinets are horizontal cabinets constructed with interior and exterior sheet metal skins surrounding an insulated core. Refrigerated coils, fastened to the inner skin, provide the cooling means for maintaining temperatures in the range of 0 to 10°. The top of these cabinets is normally provided with a sneeze guard and translucent covers. Combined, these features allow only limited viewing of the product.

A principal reason that the aforementioned design has become conventional is that it provides a thermally stable environment, a condition which enhances product quality and increases shelf life. Frozen dairy products contain a high concentration of water and, even though at low temperature, water molecules tend to diffuse through and migrate out of the product. This diffusion is driven by vapor pressure differences which relate to temperatures in general, and dew point temperatures in particular. The greater the difference between the dew point of the product and its surroundings, the greater the diffusion rate and moisture loss. If the air surrounding the product is in motion, say by forced convection, the rate of loss is increased. This moisture migration degrades product quality.

Cyclical temperature variations also have a negative effect on ice-cream quality. At normal serving temperatures, the water in ice-cream is present in both solid and liquid states. Cyclical temperature changes cause melting and freezing with an accompanying agglomeration of ice crystals.

Hence, the traditional ice-cream cabinet has a "cold wall" construction. The inner surfaces of the cabinet are refrigerated. Conduction and natural convection are the principal means of heat transfer from the product. Air is not circulated, and the environment is stable. Moreover, the thermal inertia of the design dampens temperature variations. Both dew point temperature differences and cyclical variations are small, fulfilling the conditions that enhance product quality.

Conventional "cold wall" dipping cabinets have proven to be functionally satisfactory insofar as temperature variations are minimized. However, this conventional structure greatly restricts the customer's view of the product within the cabinet. Accordingly, there exists a need in the art for a dipping cabinet which retains the qualities of conventional dipping cabinets while readily permitting visualization of the food product stored therein.

SUMMARY OF THE INVENTION

The present invention is directed toward an improved ice cream dipping cabinet which readily permits visualization of frozen food product stored therein. According to the present invention, visual access to the stored products is increased while temperature variations and moisture losses are minimized. The dipping cabinet according to the present invention has an inner box that is at least partially surrounded by an outer box. Cold, refrigerating air is circulated between the inner and outer boxes, cooling the inner box walls and the food product stored therein.

In further accordance with the present invention, the inner and outer boxes have an upper, transparent portion to permit visualization of food products stored within the inner box. The inner box transparent portion includes a top wall, upper door, and at least a portion of a front or rear wall.

In further accordance with the present invention, the inner box has a door that is hermetically sealed to a top wall thereof to prevent moisture migration from the inner box. The outer box has an open top to permit access to the inner box door.

BRIEF DESCRIPTION OF THE DRAWINGS

These and further features of the present invention will be apparent with reference to the description and drawings, wherein.

DETAILED DESCRIPTION OF THE PREFERRED EMBODIMENT

Figure 1:
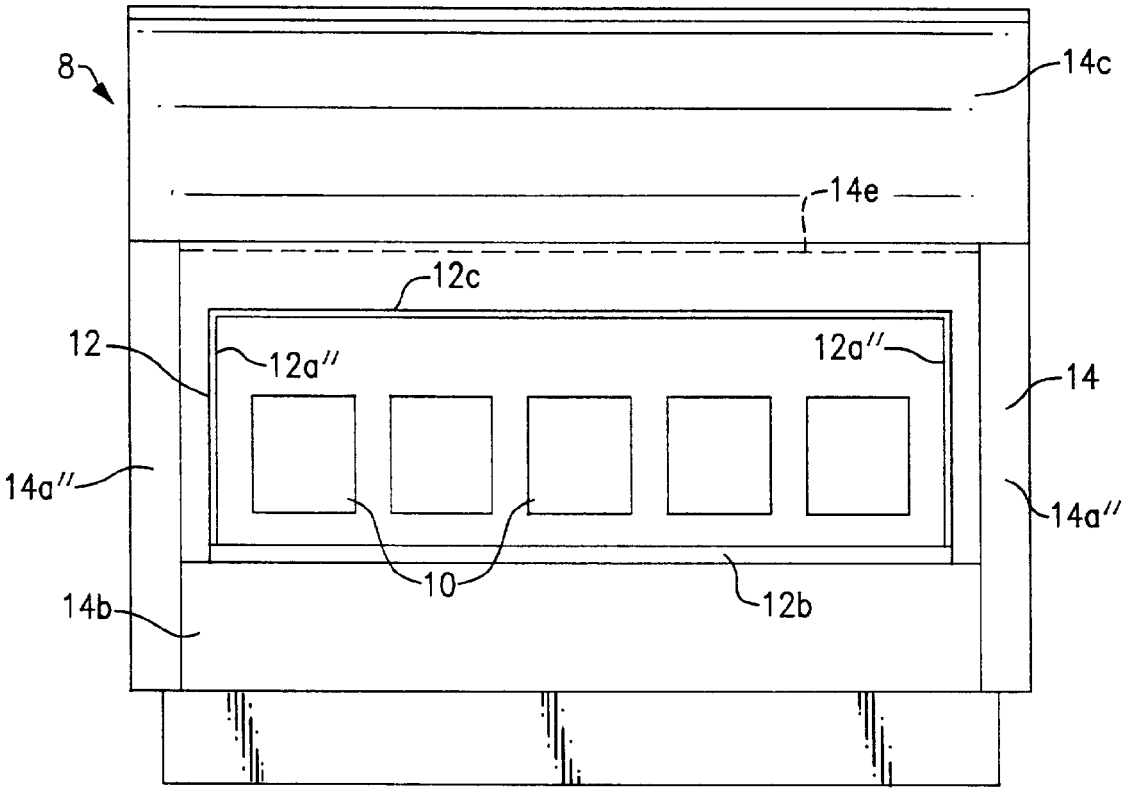
FIG. 1 is a front elevational view of a dipping cabinet according to the present invention.
Figure 2:
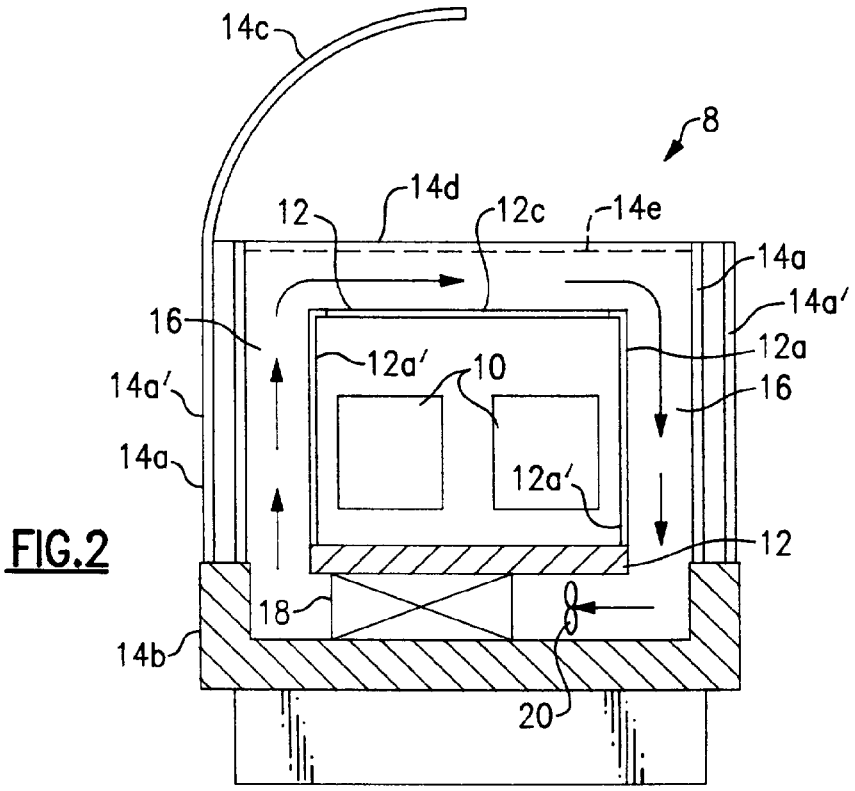
FIG. 2 is a cross-sectional view of the dipping cabinet shown in FIG. 1.

In the dipping cabinet 8 according to the present invention, shown in the drawings, the frozen food product 10 is situated within an inner box or compartment 12. The inner box 12 is disposed within and surrounded by an outer box 14.

The inner box preferably includes a transparent upper portion 12*a* and a base portion 12*b*. The upper portion 12*a* preferably includes transparent front and rear side walls 12*a*', a pair of transparent end walls 12*a*", and one or more transparent doors 12*c* through which access may be gained to the food product 10. As will be apparent to one skilled in the art, the door(s) 12*c* may be pivotally or slidably mounted to the upper portion 12*a* of the inner box 12. The inner box is hermetically sealed and receives the product 10.

The outer box 14 includes an upper transparent portion 14*a* and a lower base portion 14*b*. The upper portion 14*a* includes transparent front and rear side walls 14*a*', a pair of transparent end walls 14*a*"and a shield or sneeze guard 14*c*. The outer box end walls 14*a*" are preferably spaced outwardly from the inner box end walls 12*a*", as illustrated. Alternatively, the outer box end walls and inner box end walls may be provided by common end walls (not shown), and the inner box top, front, rear walls may be secured to the common end walls.

The upper portion 14*a* is preferably open at a top side 14*d* thereof to permit direct access to the door(s) 12*c* on the inner box upper portion 14*a*. Alternatively, the upper portion 14*a* may include one or more pivotal or slidable doors 14*e* to limit loss of cold air from the cabinet 8.

A principal function of the inner box 12 is to provide a barrier to moisture migration from the product 10. Refrigerated air circulates in a passage 16 around the inner box or compartment 12, and cools the box 12 and food 10 therein to a nominal temperature of 0° F. Because the inner box 12 is a vapor barrier and is surrounded by the air stream in the passage 16 at a uniform temperature, the inner box interior dew point reaches equilibrium with that of the product 10.

Cooling is provided by a direct expansion coil 18 and the refrigerated air is forced through the passage 16 defined between the inner box 12 and the outer box 14 by a fan 20. Cooling air flows in the passage 16 between the front walls and rear walls 12*a*', 14*a*' of the inner and outer boxes 12, 14, and between the end walls 12*a*", 14*a*" of the inner and outer boxes 12, 14. If doors 14*e* are provided by the outer box 14, cooling air is confined and circulates in the space between the outer box door(s) 14*e* and the inner box door(s) 12*c*. If door(s) 14*e* are not provided, a substantial portion of the cooling air is drawn over the inner box door(s) 12*c* and continues to circulate around the inner box 12.

Unlike the traditional design, the walls of the outer box 14 do not contain cooling coils. Rather, the outer box walls are insulative and, consequently, thermal-pane glass may be used in their construction. Provision of thermal-pane glass walls for the outer box upper portion 14*a* permits the user to see into the cabinet 8. Likewise, provision of transparent upper portions 12*a*, 14*a* for the inner and outer boxes permits the customer and sales person to easily see the product 10 being displayed for sale.

This design, incorporating glass for the front and perhaps side walls of the outer box 14, together with the transparent upper portion of the inner box 12, provides a full view of the cabinet interior. At the same time, a thermally stable environment, needed to maintain product quality, is achieved. Preferably, the inner box base portion 12*b* is spaced slightly above a lower end of the outer box front and rear side walls 14*a*' to facilitate viewing of products placed on the base portion 12*b*. For ease of manufacture, the inner box base portion 12*b* may be an upper wall of the outer box base portion 14*b*.

While the preferred embodiment of the present invention is shown and described herein, it is to be understood that the same is not so limited but shall cover and include any and all modifications thereof which fall within the purview of the invention.

What is claimed is:

1. A dipping cabinet for storage of frozen foods, comprising:

an outer box comprising a base portion and an upper portion, said base portion being formed from a heat insulating material and comprising a plurality of side walls and a lower wall, said upper portion extending upwardly from said side walls and being at least partially formed from a generally transparent material;

an inner box at least partially surrounded by said outer box and adapted to receive frozen food therein, said inner box comprising a base portion and an upper portion, said inner box upper portion being generally transparent to permit viewing of frozen foods contained within said inner box via the transparent upper portions of the inner and outer boxes, said inner box further comprising an inner box door operable between a closed position to substantially close the inner box and an open position to allow access to the frozen food, said inner box door having an outer surface;

refrigeration means including an evaporator and fan disposed in a chamber at least partially delimited by the outer box base portion and the inner box base portion;

wherein said inner box is defined independently of and spaced from said outer box to define a passageway around the inner box through which cooling air from said refrigeration means flows, said cooling air flowing past said outer surface of said inner box door and in contact with said outer surface when said inner box door is in the closed position, said cooling air being isolated from said stored food by means of said inner box and said inner box door in the closed position.

2. A dipping cabinet according to claim 1, wherein said outer box upper portion includes a plurality of side and end walls, and said inner box upper portion comprises a plurality of side and end walls.

3. A dipping cabinet according to claim 2, wherein said inner box side walls are spaced inwardly from said outer box side walls.

4. A dipping cabinet according to claim 2, wherein at least one of said inner box side walls is transparent and at least one of said outer box side walls is transparent.

5. A dipping cabinet according to claim 2, wherein said inner box end walls are spaced inwardly from said outer box and walls.

6. A dipping cabinet according to claim 2, wherein said inner box has a top wall which receives said inner box door.

7. A dipping cabinet according to claim 2, wherein said outer box has a top wall which receives an outer box door.

8. A dipping cabinet according to claim 5, wherein said outer box has a top wall which receives an outer box door.

9. A dipping cabinet according to claim 1, wherein said inner box base portion is provided by an upper wall of said outer box base portion.

10. A dipping cabinet according to claim 9, wherein said outer box upper portion includes a plurality of side and end walls, and said inner box upper portion comprises a plurality of side and end walls.

11. A dipping cabinet according to claim 10, wherein said upper wall of said outer box base portion is disposed near a lower edge of said outer box side walls.

12. A dipping cabinet according to claim 11, wherein said inner box side walls are spaced inwardly from said outer box side walls.

13. A dipping cabinet according to claim 11, wherein at least one of said inner box side walls is transparent and at least one of said outer box side walls is transparent.

14. A dipping cabinet according to claim 11, wherein said inner box end walls are spaced inwardly from said outer box end walls.

15. A dipping cabinet according to claim 11, wherein said inner box has a top wall which receives said inner box door.

16. A dipping cabinet according to claim 11, wherein said outer box has a top wall which receives an outer box door.

17. A dipping cabinet according to claim 14 wherein said outer box has a top wall which receives an outer box door.

18. A dipping cabinet for storage of frozen foods, comprising:

an outer box comprising a base portion and an upper portion, said base portion being formed from a heat insulating material and comprising a plurality of side walls and a lower wall, said upper portion extending upwardly from said side walls and being at least partially formed from a generally transparent material;

an inner box at least partially surrounded by said outer box and adapted to receive frozen food therein, said inner box comprising a base portion and an upper portion, said inner box upper portion being generally transparent to permit viewing of frozen foods contained within said inner box via the transparent upper portions of the inner and outer boxes;

a door substantially closing the inner box and having an outer surface, the door allowing access to the frozen food;

refrigeration means including an evaporator and fan disposed in a chamber at least partially delimited by the outer box base portion and the inner box base portion;

wherein said inner box is spaced from said outer box to define a passageway around the inner box in which cooling air from said refrigeration means flows, said cooling air flowing past said outer surface of said door and in contact with said outer surface, said cooling air being isolated from stored food by means of said inner box.

19. The glass dipping cabinet of claim 18, wherein the outer cabinet in provided with an opening providing access to the inner box door.

* * * * *